US009488148B2

(12) United States Patent
Hosaka et al.

(10) Patent No.: US 9,488,148 B2
(45) Date of Patent: Nov. 8, 2016

(54) ENGINE STARTING DEVICE

(71) Applicant: Nissan Motor Co., Ltd, Yokohama-shi, Kanagawa (JP)

(72) Inventors: Yuuichi Hosaka, Kawasaki (JP); Motoyuki Hattori, Atsugi (JP); Masaya Furushou, Yokohama (JP); Toshihiko Ootsuka, Atsugi (JP); Hiromoto Shimizu, Yokohama (JP); Ryo Sano, Kawasaki (JP)

(73) Assignee: Nissan Motor Co., Ltd., Yokohama (JP)

( * ) Notice: Subject to any disclaimer, the term of this patent is extended or adjusted under 35 U.S.C. 154(b) by 61 days.

(21) Appl. No.: 14/375,443

(22) PCT Filed: Mar. 11, 2013

(86) PCT No.: PCT/JP2013/056571
§ 371 (c)(1),
(2) Date: Jul. 30, 2014

(87) PCT Pub. No.: WO2013/137163
PCT Pub. Date: Sep. 19, 2013

(65) Prior Publication Data

US 2015/0007695 A1 Jan. 8, 2015

(30) Foreign Application Priority Data

Mar. 15, 2012 (JP) ..... 2012-058068
Sep. 24, 2012 (JP) ..... 2012-209160

(51) Int. Cl.
*F02N 11/08* (2006.01)
*F02N 19/00* (2010.01)

(52) U.S. Cl.
CPC ..... *F02N 11/08* (2013.01); *F02N 11/087* (2013.01); *F02N 19/001* (2013.01); *F02N 2250/02* (2013.01); *Y10T 74/131* (2015.01)

(58) Field of Classification Search
CPC ..... F02N 11/08; H02P 5/74
USPC ..... 318/139, 34, 558
See application file for complete search history.

(56) References Cited

U.S. PATENT DOCUMENTS 6,104,157 A * 8/2000 Kramer ..... F02N 11/0851 318/430
7,077,092 B2 * 7/2006 Senda ..... F02N 11/087 123/179.3
8,344,530 B2 * 1/2013 Nakayama ..... F02N 15/067 290/38 R
2004/0168664 A1 9/2004 Senda et al.

FOREIGN PATENT DOCUMENTS

EP 1 041 277 A1 10/2000
JP 2004-257369 A 9/2004
JP 2009-287459 A 12/2009
JP 2011-94555 A 5/2011
JP 2011-241779 A 12/2011

* cited by examiner

*Primary Examiner* — David S Luo
(74) *Attorney, Agent, or Firm* — Global IP Counselors, LLP

(57) ABSTRACT

An engine starting device is basically provided with a resistor, a bypass circuit and a switch. The resistor is configured to be disposed in series between a starter motor and a battery. The bypass circuit is disposed in parallel with respect to the resistor. The switch is configured to selectively open and close the bypass circuit, the switch opening the bypass circuit in response to commencement of engine startup, and closing the bypass circuit in response to the battery voltage approaches a maximum value during engine startup.

7 Claims, 4 Drawing Sheets

ENGINE STARTING DEVICE

CROSS-REFERENCE TO RELATED APPLICATIONS

This application is a U.S. National stage application of International Application No. PCT/JP2013/056571, filed Mar. 11, 2013, which claims priority to Japanese Patent Application No. 2012-058068 filed in Japan on Mar. 15, 2012 and Japanese Patent Application No. 2012-209160 filed in Japan on Sep. 24, 2012.

BACKGROUND

1. Field of the Invention

The present invention relates to an engine starting device.

2. Background Information

In conventional engine starting devices, a large current flows at the initial stage of starter motor energization (at the start of rotation of the crank shaft); therefore, the output voltage of the battery decreases so as to depend on the characteristics of the battery. This decrease in voltage has effects such as noise contamination and power supply cutoff on the electrical equipment installed in the vehicle. In contrast, the engine starting device disclosed in Japanese Laid-Open Patent Application No. 2004-257369 employs a configuration in which, in order to both suppress a decrease in battery voltage at the initial stage of starter motor energization and secure an output during cranking, a resistor and a bypass circuit are disposed in parallel between the battery and the starter motor, the bypass circuit is opened after engine startup has commenced until the engine exceeds the first upper dead center, and the bypass circuit is closed upon the engine exceeding the first upper dead center.

SUMMARY

However, in the above prior art, the battery voltage is at the minimum after the rotation of the engine has commenced. Therefore, a problem is presented in that the engine starting device must be designed so as to take factors such as the counter-electromotive force and fluctuating parameters regarding the engine (rotation fluctuation and driving load for auxiliary devices) into account so that the minimum voltage is no less than an allowable value at which electrical equipment is not affected, increasing the design complexity.

An object of the present invention is to provide an engine starting device in which an increase in design complexity can be suppressed.

In the present invention, the bypass circuit is opened when engine startup commences, and the bypass circuit is closed when the battery voltage approaches a maximum value during engine startup.

In the present invention, the battery voltage is at the minimum prior to the engine startup commencing. Therefore, there is no need to take into account factors such as the counter-electromotive force and fluctuating parameters regarding the engine, and an increase in design complexity can be suppressed.

BRIEF DESCRIPTION OF THE DRAWINGS

Referring now to the attached drawings which form a part of this original disclosure.

DETAILED DESCRIPTION OF THE EMBODIMENTS

A preferred mode for carrying out the engine starting device according to the present invention will now be described with reference to an embodiment shown in the accompanying drawings.

First Embodiment

Figure 1:
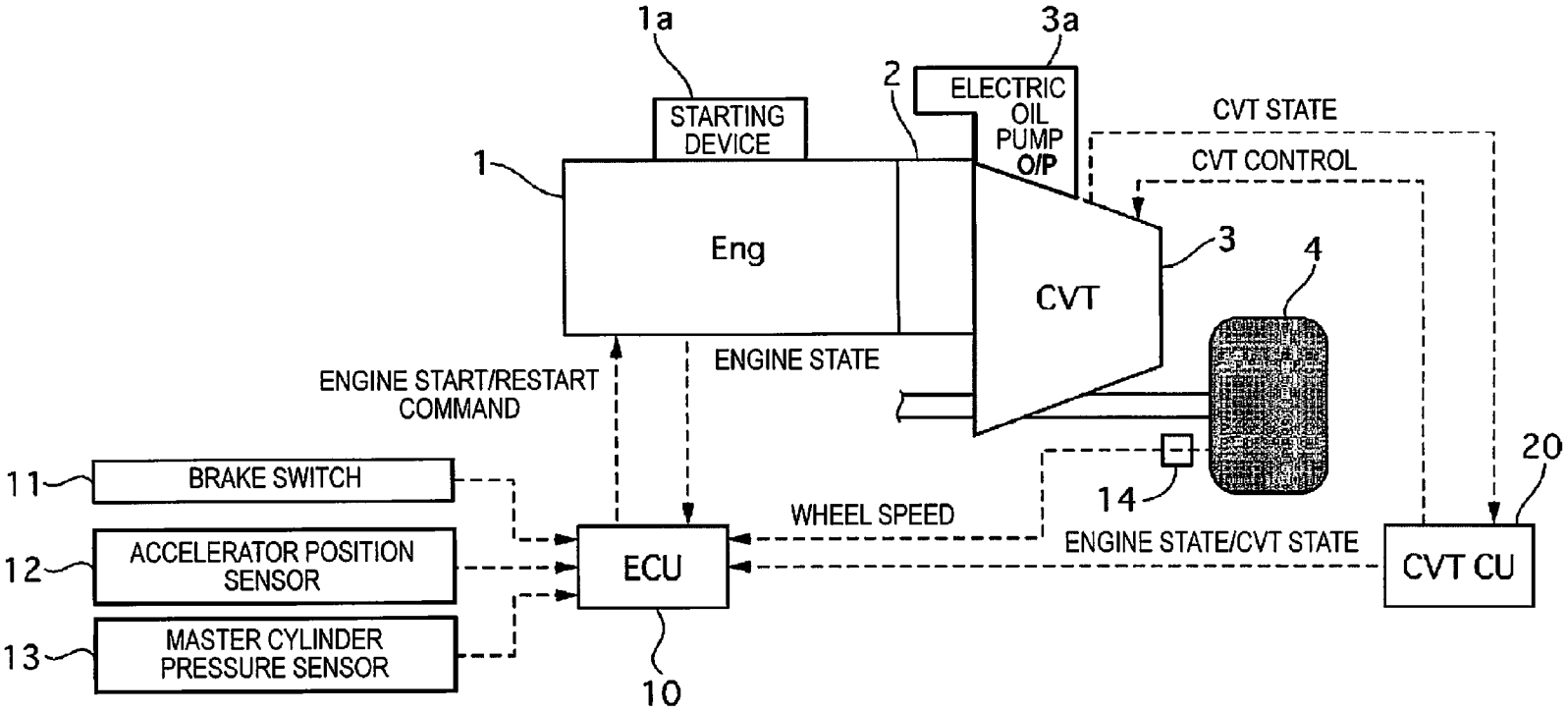
FIG. 1 is a system diagram showing a vehicle driving system according to a first embodiment.

First, the configuration of a first embodiment will be described. FIG. 1 is a system diagram showing a vehicle driving system according to the first embodiment. A rotary driving force inputted from an engine 1 is inputted through a torque converter 2 into a belt-type continuously variable transmission 3, changed in speed according to a predetermined transmission ratio, and transmitted to a driving wheel 4. The engine 1 has a starting device 1*a*. Specifically, the starting device 1*a* is provided with a starter motor 21 (see FIG. 2), and performs engine cranking and injects fuel on the basis of an engine startup command, and stops the starter motor 21 once the engine 1 is able to self-rotate.

The torque converter 2 having a lockup clutch which amplifies the torque at a stop-speed range and prevents relative rotation at a predetermined vehicle speed (e.g., about 14 km/h) or above is provided to the output side of the engine 1. The belt-type continuously variable transmission 3 is connected to the output side of the torque converter 2. The belt-type continuously variable transmission 3 comprises a starter clutch, a primary pulley and a secondary pulley, and a belt extended across the two pulleys, and changes the pulley groove width by hydraulic control to achieve the desired transmission ratio. An oil pump driven by the engine 1 is provided in the belt-type continuously variable transmission 3. When the engine is in operation, the hydraulic pressure from the oil pump feeds the lockup clutch pressure and the converter pressure for the torque converter 2, and also feeds the clutch engagement pressure and the pulley pressure for the belt-type continuously variable transmission 3. In addition, an electric oil pump 3*a* is provided to the belt-type continuously variable transmission 3. When the feeding of hydraulic pressure by the oil pump is no longer possible due to automatic stopping of the engine, the electric oil pump 3*a* operates and feeds the necessary hydraulic pressure to each of the actuators. Accordingly, even when the engine is stopped, the desired transmission ratio can be achieved and the clutch engagement pressure can be maintained.

The operation state of the engine 1 is controlled by an engine control unit 10. A brake signal from a brake switch 11, which is caused to output an ON signal by operation of a brake pedal by the driver; an accelerator signal from an accelerator position sensor 12 for detecting the amount by which the accelerator pedal is being operated by the driver; a brake operation amount signal (master cylinder pressure) from a master cylinder pressure sensor 13 for detecting the master cylinder pressure generated on the basis of the amount by which a brake pedal is operated; a vehicle speed signal from vehicle speed sensors 14 provided to each wheel; a CVT state signal from a CVT control unit 20 described further below; and signals representing parameters such as the engine coolant temperature, the crank angle, and the engine rotation speed, are inputted into the engine control unit 10. The engine control unit 10 starts, or automatically stops, the engine 1 on the basis of the above signals. It is also possible to use, instead of the master cylinder pressure sensor 13, another sensor such as a depression sensor for detecting the size of the brake pedal stroke or the force by which the brake pedal is depressed or a sensor for detecting the wheel cylinder pressure, and thereby detect the amount by which the brake pedal is operated and thus detect the intention to brake on the part of the driver.

The CVT control unit 20 transmits and receives, with respect to the engine control unit 10, signals representing the engine operation state and the CVT state, and controls parameters such as the gear ratio of the belt-type continuously variable transmission 3 on the basis of the signals. Specifically, while a travel range is selected, the CVT control unit 20 engages the starter clutch, determines the transmission ratio from a transmission ratio map on the basis of the accelerator pedal position and the vehicle speed, and controls the pulley hydraulic pressures. When the vehicle speed is less than a predetermined vehicle speed, the CVT control unit 20 disengages the lockup clutch. When the vehicle speed is equal to or greater than the predetermined vehicle speed, the CVT control unit 20 engages the lockup clutch and puts the engine 1 and the belt-type continuously variable transmission 3 in a directly connected state. When the engine is automatically stopped while the travel range is selected, the CVT control unit 20 causes the electric oil pump 3*a* to operate and secures the necessary hydraulic pressure.

Idling Stop Control

A description will now be given for idling stop control performed by the engine control unit 10. The engine control unit 10 performs "idling stop control", in which the engine 1 is automatically stopped when a predetermined engine-stop condition is met, and the starter motor 21 (see FIG. 2) is operated and the engine 1 is restarted when a predetermined engine-restart condition is met. The engine-stop condition for the idling stop control is that all of the following four conditions are met, and the engine-restart condition is that one of the four conditions is not met.

Figure 2:
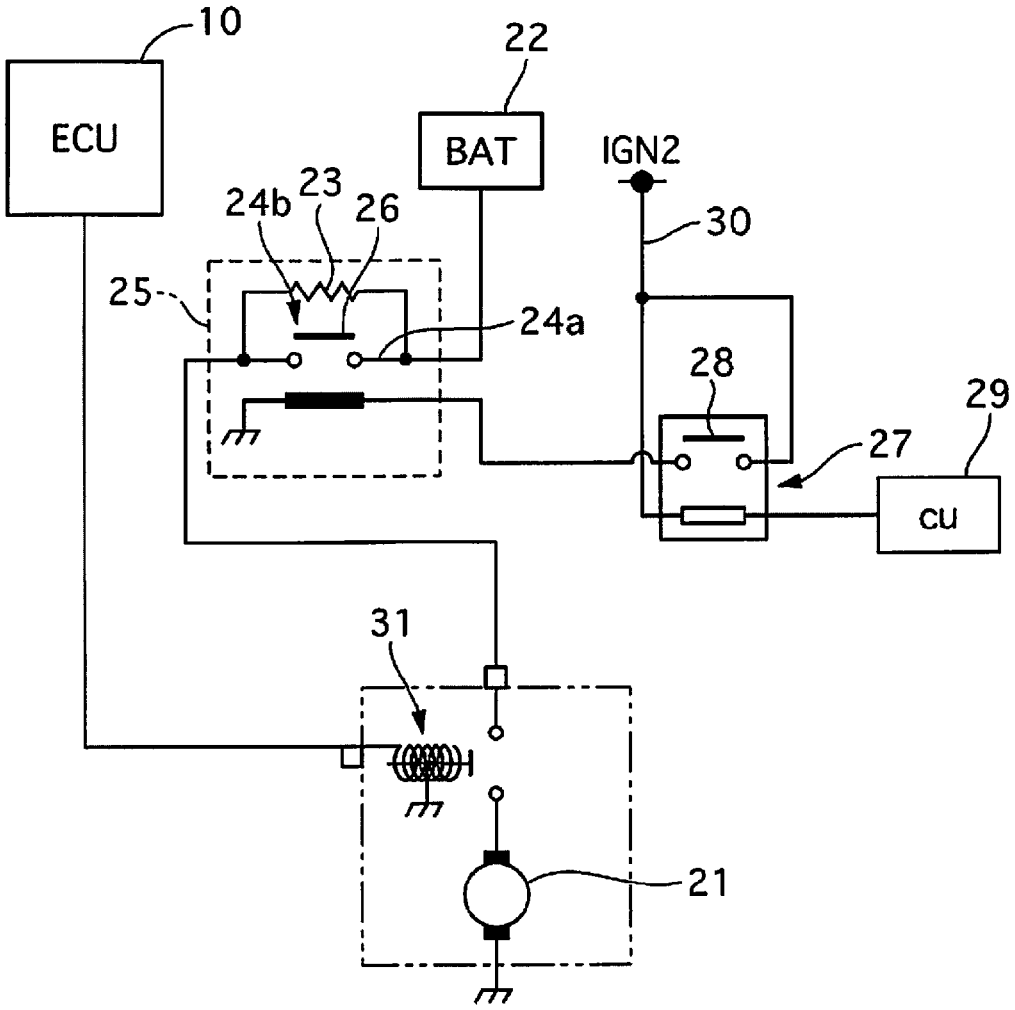
FIG. 2 is a circuit configuration diagram of an engine starting device according to the first embodiment.

1. The brake switch 11 is ON
2. The amount by which the accelerator pedal is being operated is zero
3. A travel range (D-range) is selected
4. A vehicle speed of zero being maintained for a predetermined time Engine Starting Device FIG. 2 is a circuit configuration diagram of the engine starting device according to the first embodiment. The output shaft of the starter motor 21 is connected to the engine 1 via a belt (not shown). A battery 22 feeds a DC current to the starter motor 21. The inrush current limit circuit 25, comprising a resistor 23 and a bypass circuit 24*a* connected in parallel, is interposed between the battery 22 and the starter motor 21. The resistor 23 keeps the current flowing into the starter motor 21 during engine startup to a predetermined value or less.

A bypass relay (switching means) 24*b* is provided to the bypass circuit 24*a*. The bypass relay 24*b* has a normally open contact 26, and is actuated (i.e., the contact is closed) by a current fed from a driving relay 27. A state in which the bypass circuit 24*a* is open (i.e., a state in which the normally open contact 26 is open) will hereafter be referred to as OFF, and a state in which the bypass circuit 24*a* is closed (i.e., a state in which the normally open contact 26 is closed) will hereafter be referred to as ON. The driving relay 27 has a normally open contact 28, and is actuated (i.e., the contact is closed) by a command from the controller 29. When the normally open contact 28 of the driving relay 27 closes, a current is fed to the bypass relay 24*b* from a current feed path 30.

When an ignition key (not shown) is set to an ON-position, or when the engine-restart condition for the idling stop control is met, the controller 29 outputs a command to the driving relay 27 to open the normally open contact 28, whereby the feeding of the current to the bypass relay 24*b* is blocked and the bypass circuit 24*a* is switched OFF, and when the engine exceeds the first lower dead center, the controller 29 outputs a command to close the normally open contact 28, whereby the current from the current feed path 30 is fed to the bypass relay 24*b* and the bypass circuit 24*a* is switched ON.

The current feed path 30 is connected to an IGN2 line. The IGN2 line is a path in which a current is fed from the battery 22 when the ignition key switch is set to the ON-position and the feeding of the current from the battery 22 is blocked when the ignition key switch is set to an engine startup position ST. Electrical devices that are required to actuate during the operation of the engine but are not required to actuate during engine startup based on operation of the key by the driver (i.e., initial engine startup based on driver operation) (e.g., air conditioner, instrumentation) are connected to the IGN2 line.

A coil relay 31 switched ON/OFF by the engine control unit 10 is provided between the battery 22 and the starter motor 21 at a position further towards the starter motor 21 than the resistor 23 or the inrush current limit circuit 25. When the ignition key switch is set to the engine startup position ST, or when the idling stop control requests the engine 1 to be restarted, the engine control unit 10 switches the coil relay 31 ON, feeds a current from the battery 22 to the starter motor 21, and drives the starter motor 21, until the engine rotation speed reaches a set value (e.g., the cranking rotation speed).

Bypass Relay ON/OFF Switching Process

Figure 3:
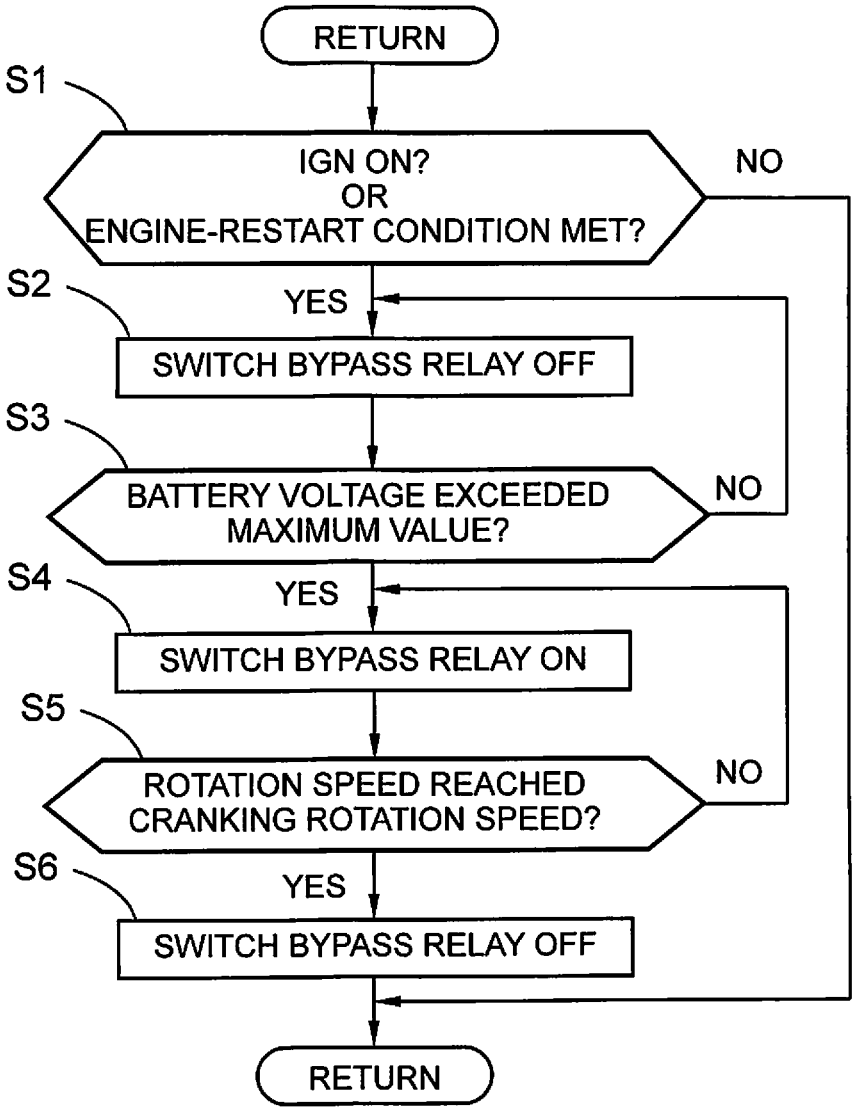
FIG. 3 is a flow chart showing the flow of an ON/OFF switching process performed on a bypass relay by a controller according to the first embodiment.

FIG. 3 is a flow chart showing the flow of an ON/OFF switching process performed on the bypass relay 24*b* by the controller 29 in the first embodiment. Each of the steps will now be described. In step S1, it is determined whether or not the ignition key switch has been set to the ON-position or the engine-restart condition for the idling stop control has been met; if YES, the flow proceeds to step S2, and if NO, the flow proceeds to RETURN. In step S2, the bypass relay 24*b* is set to OFF (open), and the bypass circuit 24*a* is opened.

In step S3, it is determined whether or not the engine 1 has exceeded the first lower dead center. i.e., whether or not the battery voltage has approached the maximum during engine startup; if YES, the flow proceeds to step S4, and if NO, the flow returns to step S2. Whether or not the lower dead point has been exceeded can be determined according to whether or not the crank angle is at a predetermined angle, whether or not the cylinder internal pressure is at the minimum value, and whether or not the differential value of the battery voltage, the battery current, or the engine rotation speed has changed from a value greater than zero to zero (i.e., whether or not the battery voltage, the battery current, or the engine rotation speed has reached a maxima). A determination can also be made according to whether or not a predetermined time has elapsed since energization of the starter motor 21 has commenced. Alternatively, a determination can also be made according to whether or not the battery voltage has exceeded a predetermined voltage, or whether or not the engine rotation speed has exceeded a predetermined rotation speed. The predetermined voltage or the predetermined rotation speed can be established in advance to a value immediately prior to the battery voltage reaching the maximum value. In step S4, the bypass relay 24*b* is switched ON (closed) and the bypass circuit 24*a* is closed. In step S5, it is determined whether or not the engine rotation speed has reached the cranking rotation speed (i.e., the rotation speed at which engine startup is determined to be complete); if YES, the flow proceeds to step S6, and if NO, step S5 is repeated. In step S6, the bypass relay 24*b* is switched OFF (open), and the bypass circuit 24*a* is opened.

Figure 4:
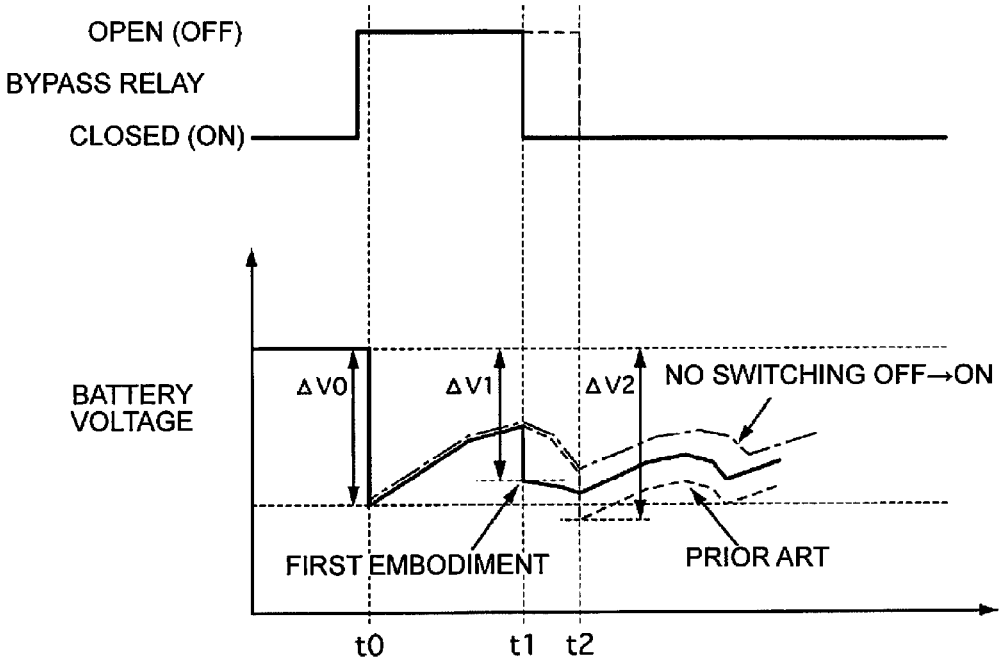
FIG. 4 is a time chart showing the bypass relay ON/OFF switching action according to the first embodiment.

The effect will now be described. FIG. 4 is a time chart showing the bypass relay ON/OFF switching action according to the first embodiment. In prior art, as shown by the broken line in FIG. 4, the bypass relay is switched from OFF to ON when the engine exceeds the upper dead center (t2) after starter motor energization has commenced. Because the engine friction is the largest in the vicinity of the upper dead center at which the compression pressure is the largest, the amount of decrease in voltage (ΔV2) for the decrease in voltage that occurs when the engine exceeds the first upper dead point (t2) (i.e., the second decrease in voltage) is greater than the amount of decrease in voltage (ΔV0) for the decrease in voltage that occurs when rotation of the crank shaft is commenced (t0) (i.e., the first decrease in voltage), and the battery voltage is at the minimum at the time of the second decrease in voltage.

Therefore, it is necessary to design the engine starting device (e.g., the resistance of the resistor) so that the minimum voltage does not fall below the allowable value. However, because the second decrease in voltage represents a decrease in voltage after the engine rotation has already commenced, in order to predict the minimum voltage of the battery, it is necessary to take fluctuating parameters regarding the engine, such as the engine rotation fluctuation and the driving load for auxiliary devices (such as the oil pump) into account. Also, the minimum voltage at the time of the second decrease in voltage is significantly dependent on the counter-electromotive force generated when the rotation of the crank shaft is commenced, and the counter-electromotive force fluctuates for a variety of reasons. Therefore, in the prior art, a problem is presented in that it is necessary to design not only the resistor but also electrical devices and the starter motor on the basis of a variety of factors that affect the fluctuating parameters regarding the engine and the counter-electromotive force, therefore increasing the design complexity.

In contrast, in the first embodiment, the bypass relay 24*b* is switched from OFF to ON when, immediately after the engine startup has commenced, the engine 1 exceeds the first lower dead point (t1), i.e., at the time (t1) when the battery voltage reaches a maximum during engine startup. By closing the bypass circuit 24*a* when the engine 1 exceeds the first dead center, the amount of decrease in voltage (ΔV0) at the time of the first decrease in voltage becomes larger than the amount of decrease in voltage (ΔV1) at the time of the second decrease in voltage. In other words, the amount of decrease in voltage (ΔV1) at the time of the second decrease in voltage can be made smaller than the amount of decrease in voltage (ΔV0) at the time of the first decrease in voltage.

Therefore, in the first embodiment, the resistance value of the resistor 23 need only be designed upon predicting the minimum voltage of the battery 22 prior to the rotation of the engine 1 commencing, without there being a need to account for the fluctuating parameters regarding the engine 1 and the counter-electromotive force generated when the crank shaft rotation is commenced, making it possible to facilitate prediction of the minimum voltage of the battery 22 and suppress the increase in design. At the lower dead center, the battery voltage is at the maximum, and the engine friction is at the minimum. Therefore, switching the bypass relay 24*b* from OFF to ON at this time makes it possible to prevent the minimum voltage of the battery 22 from falling below the allowable value.

The engine starting device according to the first embodiment has the following effects. The engine starting device comprises the resistor 23 disposed in series between the starter motor 21 and the battery 22, the bypass circuit 24*a* disposed in parallel with respect to the resistor 23, and the bypass relay 24*b* for opening and closing the bypass circuit 24*a*, the bypass relay 24*b* opening the bypass circuit 24*a* with the commencement of engine startup, and closing the bypass circuit 24*a* when the battery voltage approaches a maximum value during engine startup. It is thereby possible to suppress an increase in design complexity.

OTHER EMBODIMENTS

The engine starting device according to the present invention was described above based on an embodiment, but is not limited to the above configuration. The engine starting device may assume other configurations without departing from the scope of the present invention.

The invention claimed is:

1. An engine starting device comprising:

a resistor configured to be disposed in series between a starter motor and a battery;

a bypass circuit disposed in parallel with respect to the resistor; and a switch configured to selectively open and close the bypass circuit, the switch opening the bypass circuit in response to commencement of engine startup, and closing the bypass circuit in response to the battery voltage approaches a maximum value during engine startup.

2. The engine starting device according to claim 1, wherein the switch is a bypass relay.

3. The engine starting device according to claim 1, wherein the switch has a normally open contact and is actuated by electrical current to close the normally open contact.

4. The engine starting device according to claim 1, further comprising a controller programmed to output a command to actuate the switch.

5. The engine starting device according to claim 4, further comprising a driving relay electrically connected to the switch, and the driving relay being controlled by the command from the controller to selectively fed electrical current to the switch.

6. The engine starting device according to claim 5, wherein the switch has a normally open contact that is closed by electrical current.

7. The engine starting device according to claim 6, wherein the driving relay has a normally open contact that is closed by the command from the controller.

* * * * *